United States Patent [19]

Palazzolo

[11] Patent Number: 4,561,957

[45] Date of Patent: Dec. 31, 1985

[54] ELECTROLYTIC SILVER RECOVERY SYSTEM

[76] Inventor: James C. Palazzolo, 1815 Lakewood Dr., Salt Lake City, Utah 84117

[21] Appl. No.: 619,634

[22] Filed: Jun. 11, 1984

[51] Int. Cl.[4] ..... C25C 7/00

[52] U.S. Cl. ..... 204/237; 204/229

[58] Field of Search ..... 204/109, 228, 229, 237

[56] References Cited

U.S. PATENT DOCUMENTS

| | | | |
|---|---|---|---|
| 3,715,291 | 2/1973 | Bentley | 204/109 |
| 3,901,777 | 8/1975 | Bentley | 204/109 |
| 3,919,062 | 11/1975 | Lundquist et al. | 204/130 |

FOREIGN PATENT DOCUMENTS

| | | | |
|---|---|---|---|
| 3014021 | 11/1981 | Fed. Rep. of Germany | 204/109 |
| 2067598 | 7/1981 | United Kingdom | 204/109 |

*Primary Examiner*—R. L. Andrews

*Attorney, Agent, or Firm*—Trask & Britt

[57] ABSTRACT

An electrolytic silver recovery apparatus for recovering metallic silver from silver-laden solutions wherein such apparatus has liquid-level controls, interval electrical power controls and removable electrodes is disclosed. The apparatus is used particularly in conjunction with X-ray film processors to recover silver values from spent fixer solution in a manner whereby at least a substantial portion of the fixer solution may be returned to the fixer tank of a film processor.

1 Claim, 2 Drawing Figures

ELECTROLYTIC SILVER RECOVERY SYSTEM

BACKGROUND OF THE INVENTION

1. Field:

This invention relates to electrolytic techniques and apparatus for recovering silver from silver-laden fixer solutions derived from photographic and X-ray film processors.

2. Prior Art:

Various apparatus and techniques are utilized for the recovery of silver from silver-laden fixer solutions from photographic film processors.

Electrolytic techniques and apparatus employed in silver recovery systems are disclosed in the following Burgess U.S. Pat. Nos. 3,926,768 and 3,959,110; Bentley U.S. Pat. No. 3,715,291; Scheidegger U.S. Pat. No. 4,139,431; Staples U.S. Pat. No. 4,166,781; Biles U.S. Pat. Nos. 4,362,608 and 4,287,044; Wayden U.S. Pat. No. 3,964,990; Idota et al U. S. Pat. No. 4,111,766; and Higgins U.S. Pat. Nos. 4,127,465 and 4,078,983.

The Higgins patents are representative of electrolytic silver recovery systems associated with photographic film processors wherein current is adjusted proportionately in relation to the rate of film processed. Extensive electronic sensing and control circuitry is required in systems employing techniques such as those employed by Higgins.

Other systems, such as those disclosed in the Burgess patents, employ a precollection chamber into which spent fixer solution is collected. Upon collection of a preset volume of solution, the spent (silver-laden) fixer solution is dispensed automatically into an electrolytic cell which is full of treated (de-silvered) fixed solution. The cell, however, has only one discharge port, which is an overflow port. Silver-laden solution flowing into the upper portions of the cell will tend to make the upper portions of the solution in the container silver-rich. The overflow of this silver-rich solution in the upper regions of the container will tend to occur in disproportionate amounts in comparison with the original resident low-silver solution in the container. Thus, silver will be lost to the drain without being treated because of the structure of the container and the manner of introducing silver-rich solution.

SUMMARY OF THE INVENTION

Figure 1:
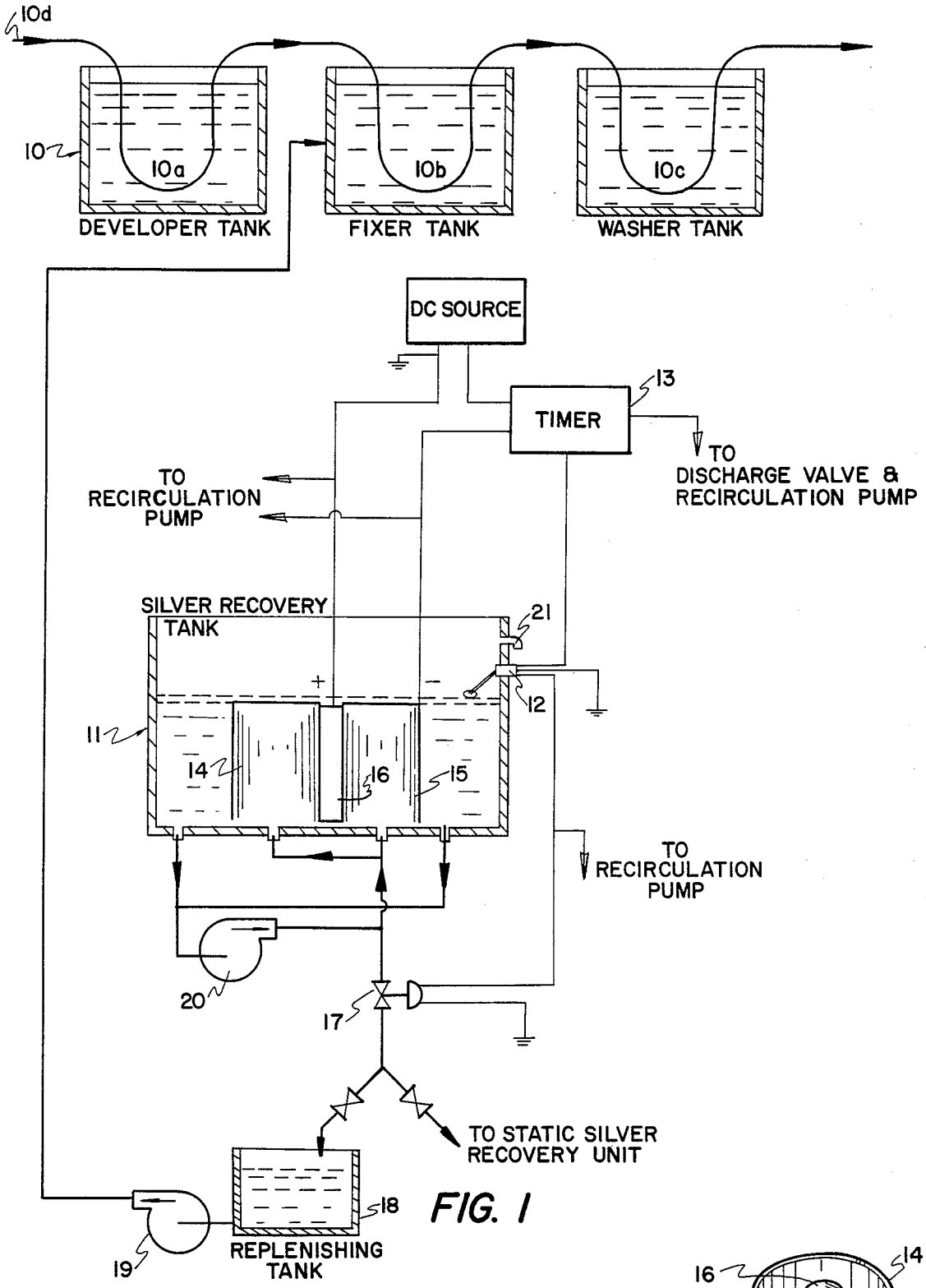
FIG. 1 is a schematic illustration of an electrolytic silver recovery unit featuring apparatus of the instant invention.

The instant invention relates to an electrolytic silver recovery technique and apparatus for effectively recovering silver from silver-laden photographic fixer solution in a manner that said fixer solution may be repeatedly recirculated to a fixer tank in a photographic film processor.

The apparatus comprises a silver recovery tank containing a significant volume of resident, treated (silver-depleted) fixer solution containing essentially no silver. An overflow line from a fixer tank in a film processor discharges directly into the silver recovery tank. Spent fixer solution containing from about 0.5 to over 1.0 ounces of silver per gallon periodically flows into the silver recovery tanks. Each film processed in a typical X-ray film processor results in the addition of about 100 milliliters (ml) of fresh fixer solution to the fixer tank of the film processor, thereby causing the overflow of about 100 ml of spent fixer solution from the fixer tank.

Typically, about 400 ml to about 1000 ml of spent fixer solution are collected, in addition to the resident treated solution, in the electrolytic silver recovery apparatus before silver recovery is commenced. The resident treated solution is usually about six to about fifteen times the volume of the spent fixer solution collected. Thus, an immediate dilution of silver concentration of the spent fixer solution occurs upon introduction of the spent fixer solution into the silver recovery tank. The silver recovery tank (SRT) has an overflow port which is usually located at a sufficient elevation above the upper level of solution in the tank after collection of spent fixer solution that inadvertent overflow of silver-rich solution does not occur.

The volume of spent fixer solution admitted to the tank before silver recovery begins is controlled by a liquid level switch located in the SRT. When the collected solution raises the total solution in the tank to a certain level, a liquid level electrical switch, which preferably is a float-type switch, electrically activates a timer which initiates the electrolytic process whereby silver is removed from the solution in the SRT. The float-type switch is fixed to the silver recovery tank wall with the float extending into the interior of the tank.

The timer is also connected to an electrode switch which controls electrical energy and energization of the cathode and anode. The timer is preset to control the flow of electrical energy to said anode and cathode for a predetermined time. A drain valve with control means is connected to the SRT to drain desilvered solution from the tank. The drain valve is opened by the timer at the conclusion of the preset time period interval and closed by the liquid level switch in its down position.

The timer is preferably a variable timer adjustable to control electrical flow for various time periods. Typically, a time period is chosen to correspond to the volume of silver-laden solution collected, the concentration of silver in the silver-laden solution and the magnitude of voltage applied to the electrodes. Although all of these factors can be varied, they are usually arbitrarily fixed by the operator so that day-in, day-out operation may be achieved without any required readjustment of the timer, float switch or voltage.

DETAILED DESCRIPTION OF THE DRAWINGS

Further description of the invention may be facilitated by reference to the attached drawings. FIG. 1 is a schematic view of a silver recovery unit representing a preferred embodiment of the instant invention. The electrolytic silver (ESRU) recovery unit operates with a film processor 10 which consists of a developer tank 10*a*, fixer tank 10*b* and a wash tank 10*c*. Film, such as X-ray film 10*d*, is threaded through these tanks beginning with the developer tank then moving to the fixer tank and finally through the wash tank. Silver material is removed from the film as it passes through the fixer tank. Some of the silver is physically carried with the film into the wash tank. Some of the developer is physically carried with the film into the fixer tank. Because of developer contamination, periodic dumping of the fixer tank is required. A useful feature of the instant invention is that the volume of the SRT is such that the fixer tank contents may be dumped into a drained SRT.

The electrolytic silver recovery unit (ESRU) comprises a silver recovery tank 11, a float switch 12 which is positioned generally more than midway up the wall of the tank, a timer 13 which controls certain functions of the ESRU such as the time period during which voltage is applied between the cathodes 14 and 15, and the anode 16. The timer also activates a solenoid controlled discharge valve 17 which discharges treated fixer solution into a replenishing tank 18 wherein at least a portion of it may be pumped by a pump 19 back to the fixer tank in the film processor. The discharge valve may also be manually activated.

The ESRU also includes a recirculation pump 20 which circulates the liquid in the silver recovery tank 11 during the period that voltage is applied to the cathodes and anodes. The silver recovery tank 11 has also an overflow 21 which preferably goes to a static silver recovery unit, e.g., of the iron filing type, before it is discharged to a drain. The overflow is located a substantial distance above the solenoid discharge valve 17 and above the level float switch 12.

Figure 2:
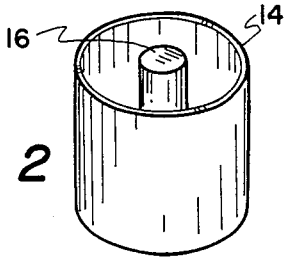
FIG. 2 is a perspective view of a cathode assembly useful in the electrolytic recovery unit of the present invention.

A particularly useful cathode assembly is illustrated in FIG. 2. Silver ions being positively charged migrate to the cathode wherein the silver ions join with an electron to form metallic silver which deposits on the cathode. The cathode is preferably constructed of a lightweight #316 stainless steel material which is a relatively effective current carrier. The cathode of this invention is a thin flat planar sheet folded to form a circular element of stainless steel.

The cathode and anode assembly comprise a pair of cylindrical stainless steel members made of thin #316 stainless steel sheet metal. The anode preferably is located concentrically within the cathode and is preferably about the same height as the cathode. The anode is about four to eight inches in height and preferably about six to eight inches tall. It is typically an open cylinder two to four inches in diameter and preferably with a diameter of about two to three inches. The area of the anode thus may vary from about 24 to about 96 square inches and preferably from about 54 square inches to about 72 square inches. The anode and cathode areas may preferably be varied depending upon volume of solution to be treated and the concentration of silver therein. The anode areas set forth herein are for about four to five gallons of solution with a silver concentration of from about 0.25 to about 0.125 ounces/gallon.

The cathode is about six to eight inches in diameter and preferably has a diameter of from about six to seven inches. The height of the cathode is within about the same range as the anode. Generally, the height of the cathode is substantially equal to that of the anode. The area of the cathode ranges from about 72 to about 192 square inches and preferably is from about 100 to about 170 square inches.

The current density at the cathode varies from less than about 0.05 amp/square inch to about 0.1 amp/-square inch. The current density at the anode ranges from less than about 0.1 amp/square inch to about 0.3 amp/square inch. The total amperage is preferably about seven amps.

The circulation system for the SRT is structured such that solution is drawn from outside the cathode and then introduced into the annulus between the anode and cathode to introduce continuously fresh solution into the electrolytic zone. The rate of circulation should be sufficiently vigorous that the solution between the anode and cathode is not permitted to "burn". For a tank having a capacity of four to six gallons, a circulation rate of four to about eight gallons per minute is quite satisfactory.

The level of solution in the SRT is preferably maintained above the top edges of the anode and cathode, especially when current is passing between the anode and cathode. Operation of the SRT under electrolytic recovery techniques with the anode and/or cathode above the solution level tends to cause frothing. To avoid all possibility of frothing, it is preferable to maintain the solution level above the top of the cathode and anode even when the current is not being applied to these electrodes. The proper solution level can be determined by selecting electrodes of the proper height with respect to location of the liquid level switch (float switch). The location of the liquid level switch is determined by the level of the overflow discharge and the ratio of solution to be admitted for treatment to the amount of resident (treated) solution present.

In the instant invention the sequence of operations begins with the overflow of silver-ladened fixer solution (spent fixer solution) from the fixer tank of the film processor to the electrolytic silver recovery unit. The used fixer solution contains typically about 0.5 to about 1.0 ounces of silver per gallon. At the time the used fixer solution flows into the electrolytic silver recovery unit the ESRU contains a significant volume of treated fixer solution, that is, fixer solution which has been electrolytically treated to reduce the silver level thereof. The concentration of silver in the resident, treated fixer solution in the ESRU generally approaches zero.

At the time used fixer solution flows into the ESRU, the discharge valve from the ESRU is in a closed position and the float switch is in a down position. Used fixer solution continues to flow periodically into the ESRU until the float switch is raised to a sufficiently high level to activate the switch in its uppermost position. The activation of the float switch in its up position then activates the timer unit. The timer unit closes a switch to the cathode-anode circuit to initiate electrolytic recovery of the silver in the ESRU. The timer also activates the circulating pump to initiate circulation of solution within the ESRU.

The current applied to the cathode and anode is generally less than about 8 amps. The period of time during which the current is on may depend upon the exact volume of the ESRU and the volume of spent fixer solution represented by differences in level between the discharge opening of the ESRU and the upper level of the float switch. Typically this volume of spent fixer is from about one gallon per hour to about two gallons per hour and the time duration during which current is applied is usually from about one hour to about two hours. Usually the volume of resident treated fixer solution is from about three to about four gallons. At the low level of current employed, the solution is not burned.

Many electrolytic units use high amperage current which can result in "burning" (sulfiding) of the fixer solution unless very precise controls are employed. Burned fixer solution contains chemicals which are broken down and the residue products are contaminates which tend to contaminate the fixer solution if it is returned to the fixer tank in a film processor. Burned fixer solution can result in spots, shadows and the like on film processed through burned fixer solution. Operation of the ESRU of the instant invention at current levels of less than about eight amps avoids burning of the fixer solution.

At the end of a predetermined time period, the timer turns off the current to the anode and cathode and opens the solenoid controlled discharge valve. The silver depleted solution flows to a replenisher tank from which it can be reintroduced to the fixer tank in the film processor. As the solution in the ESRU tank drops to the level of the discharge valve, the float switch activates in its down position to turn off the discharge valve. The ESRU has then completed one cycle and is in a condition to receive periodic overflow of used fixer solution from a fixer tank and a film processor.

In a film processor usually about 100 milliliters of fresh fixer solution is introduced into the fixer tank for each X-ray film processed. The solution in the fixer tank usually contains at least about 0.5 ounces of silver per gallon. Thus, in an ESRU which has a permanent resident volume of treated fixer solution which is at least equal to about six times up to about twenty times volume of used fixer solution introduced into the ESRU for treatment during any one cycle, the concentration of silver in the ESRU at the start of the treatment cycle is generally at least 0.02 ounces of silver per gallon. If a fixer tank of a film processor is operated at a higher concentration of silver, then a higher concentration of silver will exist in the ESRU at the beginning of the treatment cycle. It is to be understood that the resident volume of treated solution may be varied in the construction of the ESRU, for example, the permanent resident volume may be a 2:1 ratio in comparison to the volume of used fixer solution treated during any one cycle. Typically, an ESRU contains about 0.025 to about 0.125 ounces of silver per gallon at the beginning of any treatment cycle. The method of operation of a particular film processor can be determined and the amount of time set for a treatment cycle can be determined from that. The time period for a treatment cycle is generally sufficient to reduce the silver concentration in the treated solution in the ESRU to about zero ounces of silver per gallon.

An advantage of the instant invention is that there is direct communication between the overflow of the fixer tank and the ESRU recovery tank. Thus, while the current is flowing to the cathode and anode, the film processor may be operated and used fixer solution may be discharged to the ESRU. Thus, while at the start of the cycle a predetermined volume is being treated, the operation of the ESRU is at very low amperage, about $2\frac{1}{2}$ to about 7 amps, to prevent burning of the solution and it is also operated with a relatively large resident volume of treated solution. Thus, if a few hundred millimeters of used fixer solution come into the tank even late in the treatment cycle and the silver contained therein is not recovered during that particular treatment cycle, the silver concentration is diluted to such a very low volume that the solution may be readily returned to the fixer replenishment tank. For example, in an ESRU having a volume of several gallons and a concentration of silver at approximately zero, the introduction of a couple hundred milliliters of fixer solution containing 0.5 ounces of additional silver per gallon would introduce only about 0.025 ounces of silver into the ESRU whereby the silver concentration in an ESRU having a minimum of two gallon volume would result in a silver concentration of 0.125 ounces of silver per gallon. Treated fixer solution having silver concentrations of such low levels may be readily returned to a fixer tank in a film processor.

A timer useful in the instant invention for controlling the application of electrical power to the electrodes is one available from Automatic Timing & Controls Company, identified as ATC 328A. This particular timer is an NOS integrated circuit timer having a dial adjustable time delay relay with six selectable ranges which provide time delays from 0.05 seconds to 10 hours. Depending upon how it is wired into a system, the timer will operate in an on-delay, off-delay or interval mode of timing.

In the instant invention, the timer is typically wired to provide interval timing. In this mode the relay pulls in at the start of the timing period and drops out at the end of the timing period. The relay is thus energized for the entire timing interval. At the conclusion of the time interval the timer returns to a before-start condition, ready to be activated for the next timing interval.

I claim:

1. An electrolytic silver recovery unit for recovering silver from film fixer solutions and for returning desilver fixer solution to a film processing system comprising:

a tank for holding fixer solution from a film processing system from which silver is to be removed;

a removable cathode assembly sized to fit within said tank;

an anode assembly sized and shaped to cooperate electrolytically with said cathode assembly;

pump means to cause recirculation of the solution within the tank and to return desilvered fixer solution to said film processing system;

a liquid-level switch fixed to an inner wall of said tank which is activated to an on position by attainment of a predetermined upper solution level within the tank and deactivated to an off position by attainment of a predetermined lower solution level within the tank, said switch activating said pump to recirculate solution within the tank and to activate a timer unit when said switch is activated to an on position and deactivating said pump and a discharge valve when said switch is deactivated to an off position;

a timer unit connected to said liquid level switch and activated thereby, said timer also connected to an electrode switch which controls electrical energization of the cathode and anode, said timer preset to control flow of electrical energy to said anode and cathode for a predetermined time period, said timer activating a discharge control valve;

discharge valve controlled drain means to drain desilvered solution from said tank, said drain valve being opened by timer at the conclusion of the preset time interval and closed by said liquid level switch being deactivated.

* * * * *